US005865349A

United States Patent [19]

Cancilla

[11] Patent Number: 5,865,349

[45] Date of Patent: Feb. 2, 1999

[54] BOTTLE WITH INTEGRALLY COUPLED FLAP

[76] Inventor: Philip Cancilla, 341 Checker Dr. Apt. 108, San Jose, Calif. 95133

[21] Appl. No.: 917,317

[22] Filed: Aug. 25, 1997

[51] Int. Cl.[6] ..... B65D 37/00

[52] U.S. Cl. ..... 222/212; 222/494

[58] Field of Search ..... 222/212, 215, 222/490, 494

[56] References Cited

U.S. PATENT DOCUMENTS

| | | | |
|---|---|---|---|
| 4,109,836 | 8/1978 | Falarde | 222/494 |
| 4,938,390 | 7/1990 | Markva | 222/494 |

FOREIGN PATENT DOCUMENTS

| | | | |
|---|---|---|---|
| 473013 | 9/1950 | Italy | 222/494 |
| 397525 | 2/1966 | Switzerland | 222/494 |

*Primary Examiner*—Philippe Derakshani

[57] ABSTRACT

A bottle with integrally coupled flap is provided including a deformable bottle formed of an elastomeric material. A spout is formed of the elastomeric material and integrally coupled to a top of the bottle. The spout has a top face formed of an elastomeric material similar to that of the bottle and spout. The top face is integrally coupled about a circular top opening thereof. Finally, an arcuate slit is formed in the spout in coaxial alignment therewith. The slit is situated directly below the top face of the spout for defining a flap with a radius of curvature equal to that of the top face of the spout.

6 Claims, 2 Drawing Sheets

BOTTLE WITH INTEGRALLY COUPLED FLAP

BACKGROUND OF THE INVENTION

1. Field of the Invention

The present invention relates to a bottle with integrally coupled flap and more particularly pertains to providing an bottle with an integral unitary flap formed thereon.

2. Description of the Prior Art

The use of liquid dispensing flaps for bottles is known in the prior art. More specifically, liquid dispensing flaps for bottles heretofore devised and utilized for the purpose of sealing a bottle are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,938,390; U.S. Pat. No. Des. 353,334; U.S. Pat. No. 4,789,082; U.S. Pat. No. 4,696,328; and U.S. Pat. No. 5,353,968.

In this respect, the bottle with integrally coupled flap according to the present invention substantially departs from the conventional concepts and designs of the prior art, and in so doing provides an apparatus primarily developed for the purpose of providing an bottle with an integral unitary flap formed thereon.

Therefore, it can be appreciated that there exists a continuing need for a new and improved bottle with integrally coupled flap which can be used for providing an bottle with an integral unitary flap formed thereon. In this regard, the present invention substantially fulfills this need.

SUMMARY OF THE INVENTION

In view of the foregoing disadvantages inherent in the known types of liquid dispensing flaps for bottles now present in the prior art, the present invention provides an improved bottle with integrally coupled flap. As such, the general purpose of the present invention, which will be described subsequently in greater detail, is to provide a new and improved bottle with integrally coupled flap which has all the advantages of the prior art and none of the disadvantages.

To attain this, the present invention essentially comprises a deformable bottle formed of an elastomeric material having a generally planar front and rear face. A thin bottom face and a pair of thin arcuate side faces are formed therebetween for defining a generally rectangular interior space. A spout formed of an elastomeric material is integrally coupled to a top of the bottle. The spout has a generally cylindrical configuration with a plurality of threaded grooves formed therein. An outwardly extending flange is integrally coupled about a periphery of the spout below the threaded grooves. The spout further has a top face formed of an elastomeric material similar to that of the bottle and spout. It is imperative that the top face is integrally coupled about a circular top opening thereof. An arcuate slit is formed in the spout in coaxial alignment therewith. The slit is situated directly below the top face of the spout for defining a flap with a radius of curvature equal to that of the top face of the spout. It should be noted that the slit defines an arc of about 60 degrees. Lastly, a cap is provided having a circular top and a cylindrical periphery integrally coupled thereto. A plurality of threaded grooves are formed in an interior surface of the cap for releasably engaging the threaded grooves of the spout.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle with integrally coupled flap which has all the advantages of the prior art liquid dispensing flaps for bottles and none of the disadvantages.

It is another object of the present invention to provide a new and improved bottle with integrally coupled flap which may be easily and efficiently manufactured and marketed.

It is a further object of the present invention to provide a new and improved bottle with integrally coupled flap which is of a durable and reliable construction.

An even further object of the present invention is to provide a new and improved bottle with integrally coupled flap which is susceptible of a low cost of manufacture with regard to both materials and labor, and which accordingly is then susceptible of low prices of sale to the consuming public, thereby making such bottle with integrally coupled flap economically available to the buying public.

Still yet another object of the present invention is to provide a new and improved bottle with integrally coupled flap which provides in the apparatuses and methods of the prior art some of the advantages thereof, while simultaneously overcoming some of the disadvantages normally associated therewith.

Still another object of the present invention is to provide an bottle with an integral unitary flap formed thereon.

Lastly, it is an object of the present invention to provide a new and improved bottle with integrally coupled flap including a deformable bottle formed of an elastomeric material. A spout is formed of the elastomeric material and integrally coupled to a top of the bottle. The spout has a top face formed of an elastomeric material similar to that of the bottle and spout. The top face is integrally coupled about a circular top opening thereof. Finally, an arcuate slit is formed in the spout in coaxial alignment therewith. The slit is situated directly below the top face of the spout for defining a flap with a radius of curvature equal to that of the top face of the spout.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
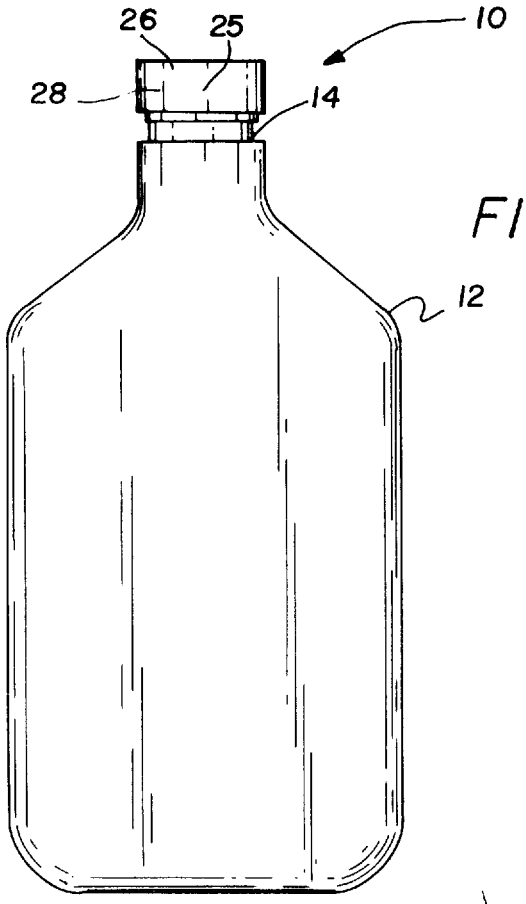
FIG. 1 is an illustration of the preferred embodiment of the bottle with integrally coupled flap constructed in accordance with the principles of the present invention.
Figure 2:
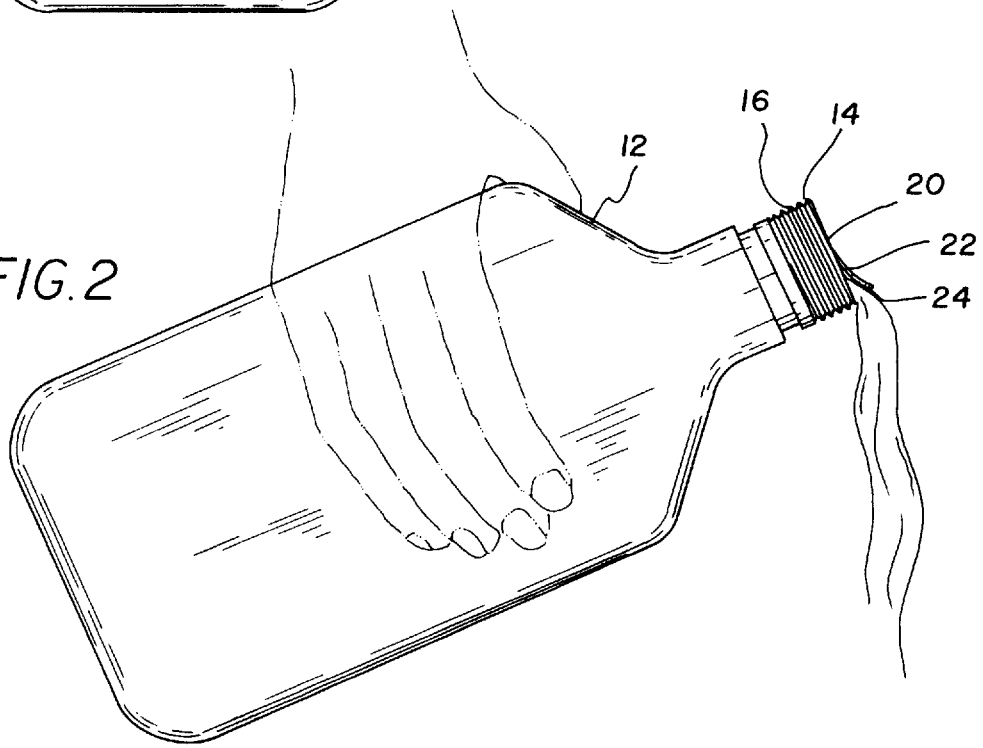
FIG. 2 is an illustration of the present invention in use.
Figure 3:
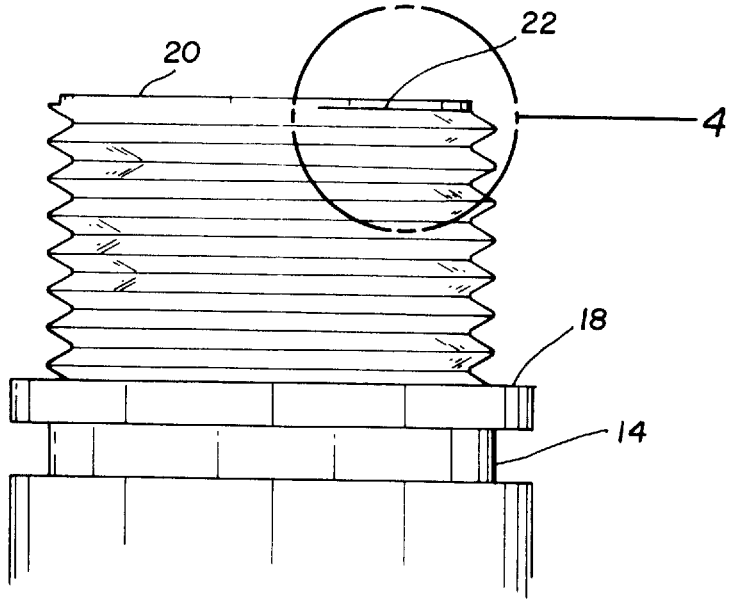
FIG. 3 is a side view of the spout of the present invention.
Figure 4:
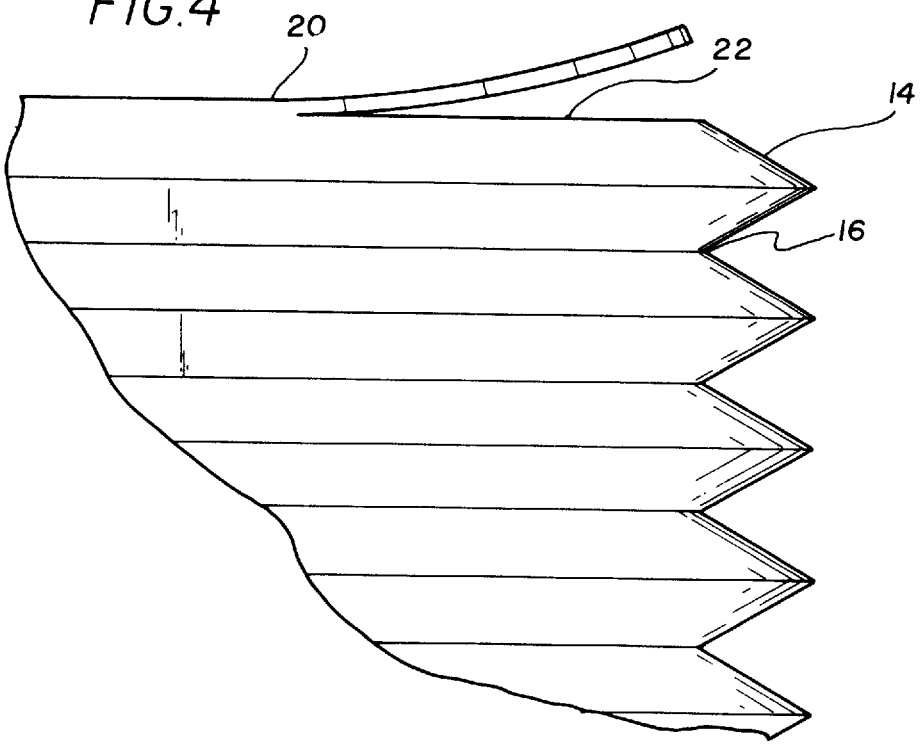
FIG. 4 is a close up view of the slit and top face of the present invention.

With reference now to the drawings, and in particular to FIG. 1 thereof, a new and improved bottle with integrally coupled flap embodying the principles and concepts of the present invention and generally designated by the reference numeral 10 will be described.

The present invention, the new and improved bottle with integrally coupled flap, is comprised of a plurality of components. Such components in their broadest context include a bottle, a spout, a top face, a slit, and a cap. Such components are individually configured and correlated with respect to each other so as to attain the desired objective.

More specifically, it will be noted that the system 10 of the present invention includes a deformable bottle 12 formed of an elastomeric material having a generally planar front and rear face. A thin bottom face and a pair of thin arcuate side faces are formed therebetween for defining a generally rectangular interior space.

A spout 14 formed of an elastomeric material is integrally coupled to a top of the bottle. The spout has a generally cylindrical configuration with a plurality of threaded grooves 16 formed in an outer surface thereof. An outwardly extending flange 18 is integrally coupled about a periphery of the spout below the threaded grooves. Below the flange is an unnumbered annular groove. The spout further has a top face 20 formed of an elastomeric material similar to that from which the bottle and spout is constructed. It is imperative that the top face be integrally coupled about a circular top opening thereof. In the preferred embodiment, the top face of the spout is constructed to be very thin. Further, it is important that the flap has a predetermined strength that renders it irremovable.

An arcuate slit 22 is formed in the spout in coaxial alignment therewith. The slit is situated directly below the top face of the spout for defining a flap 24 with a radius of curvature equal to that of the top face of the spout. It should be noted that the slit defines an arc of about 60 degrees.

Lastly, a cap 25 is provided having a circular top 26 and a cylindrical periphery 28 integrally coupled thereto. A plurality of threaded grooves are formed in an interior surface of the cap for releasably engaging the threaded grooves of the spout. Preferably, the height of the cap is such that when secured to the spout and abutted with the flange, the top thereof engages the flap only to the extent that it is level with the remaining portion of the top face of the spout.

In use, the cap may be removed and the front and rear face depressed to expel liquids through the slit. Since the flap is integrally coupled to the spout, the flap is ideally biased back to it rest orientation against the top opening of the spout. It should be understood that due to the integrally coupling of the flap, no adhesive is required.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bottle with integrally coupled flap comprising, in combination:

a deformable bottle formed of an elastomeric material having a generally planar front and rear face with a thin bottom face and a pair of thin arcuate side faces formed therebetween for defining an interior space;

a spout formed of the elastomeric material and integrally coupled to a top of the bottle, the spout having a generally cylindrical configuration with a plurality of threaded grooves formed therein and an outwardly extending flange integrally coupled about a periphery of the spout below the threaded grooves, the spout further having a top face formed of an elastomeric material similar to that of the bottle and spout and integrally coupled about a circular top opening thereof;

an arcuate slit formed in the spout in coaxial alignment therewith, the slit situated directly below the top face of the spout for defining a flap with a radius of curvature equal to that of the top face of the spout, wherein the slit defines an arc of about 60 degrees; and a cap having a circular top and a cylindrical periphery integrally coupled thereto with a plurality of threaded grooves formed in an interior surface thereof for releasably engaging the threaded grooves of the spout.

2. A bottle with integrally coupled flap comprising:

a deformable bottle formed of an elastomeric material;

a spout formed of the elastomeric material and integrally coupled to a top of the bottle, the spout having a generally cylindrical configuration, the spout further having a top face formed of an elastomeric material similar to that of the bottle and spout and integrally coupled about a circular top opening thereof; and an arcuate slit formed in the spout in coaxial alignment therewith, the slit situated directly below the top face of the spout for defining a flap with a radius of curvature equal to that of the top face of the spout.

3. A bottle with integrally coupled flap as set forth in claim 2 wherein the slit defines an arc of about 60 degrees.

4. A bottle with integrally coupled flap as set forth in claim 2 and further including a cap having a circular top and a cylindrical periphery integrally coupled thereto with a plurality of threaded grooves formed in an interior surface thereof for releasably engaging threaded grooves formed on the spout.

5. A bottle with integrally coupled flap as set forth in claim 2 wherein the bottle has a generally planar front and rear face with a thin bottom face and a pair of thin arcuate side faces formed therebetween defining an interior space.

6. A bottle with integrally coupled flap as set forth in claim 2 wherein the spout has an outwardly extending flange integrally coupled about a periphery of the spout.

* * * * *